United States Patent [19]

Atsuchi

[11] 4,149,345

[45] Apr. 17, 1979

[54] WALL BLASTER

[75] Inventor: Iwao Atsuchi, Daito, Japan

[73] Assignee: Atsuchi Tekko Co., Ltd., Osaka, Japan

[21] Appl. No.: 755,170

[22] Filed: Dec. 29, 1976

[30] Foreign Application Priority Data

Dec. 29, 1975 [JP] Japan ..... 50-157623

[51] Int. Cl.[2] ..... B24C 3/06

[52] U.S. Cl. ..... 51/424; 51/429; 51/439; 114/222

[58] Field of Search ..... 51/8 R, 8 SR, 9 M, 11, 51/12, 426, 429, 430, 439, 424, 425; 114/222

[56] References Cited

U.S. PATENT DOCUMENTS

| | | | |
|---|---|---|---|
| 1,819,331 | 8/1931 | Lytle | 51/8 SR |
| 2,729,918 | 1/1956 | Denburgh | 51/8 R |
| 3,032,929 | 5/1962 | Glesener | 51/12 X |
| 3,900,968 | 8/1975 | Shigyo | 51/9 M X |
| 3,916,568 | 11/1975 | Rose | 51/8 R |
| 4,036,437 | 7/1977 | Dreher | 51/429 X |

*Primary Examiner*—Gary L. Smith
*Attorney, Agent, or Firm*—Armstrong, Nikaido, Marmelstein & Kubovcik

[57] ABSTRACT

The wall blaster of this invention comprises a plurality of sand injection nozzles so disposed as to be directed toward an opening of a blaster housing at the front surface facing opposite to a hull surface of a vessel to be treated for injecting working sand toward the hull surface, a working sand collecting chamber provided at the lower portion of the blaster housing for collecting the working sand injected from the injection nozzles and reflected from the hull surface to be treated, a plurality of compressed air injection tubes so disposed in the vicinity of the bases of the respective injection nozzles as to direct the head of the tube toward the base of the nozzle and also to open one end of a sand hose communicating with the collecting chamber in the vicinity thereof for taking up the sand in the collecting chamber by means of an ejector action of high speed jet air flow injected therefrom and for injecting again the sand from the injection nozzles to circulate the sand in the housing, upper and lower wheels provided at the front surface of the housing, and a permanent magnet disposed at the front surface of the housing, wherein the housing is arranged adjacent over the hull surface to be treated so as to move along the hull surface while injecting the working sand from the injection nozzles.

4 Claims, 3 Drawing Figures

WALL BLASTER

BACKGROUND OF THE INVENTION

This invention relates to a wall blaster.

Metal surfaces of a building construction such as shipbuilding, gas tank, building, etc. are heretofore treated by a sandblasting work as a ground treatment for painting. The conventional wall blasting apparatus has an air compressor, a sand supply tank and a sand collecting tank provided on the ground and is so operated that the sand blaster is moved along the wall surface of the building construction and working sands are fed under pressure to the blaster arranged at high place by means of compressed air from the compressor. Thus, the compressor needs high horsepower and the blasting apparatus requires a great deal of sand.

SUMMARY OF THE INVENTION

This invention contemplates to circulate the working sand in the housing of a sand blaster but not to feed the sand upwardly to the high position from the ground. As a result, the amount of the sand may be less, and the blaster requires less blasting horsepower in operation.

One object of this invention is to provide a wall blaster which comprises a plurality of sand injection nozzles and a sand collecting chamber provided in the housing thereof so as to circulate the working sand in the housing by feeding the sand accumulated in the collecting chamber into the sand injection nozzles.

Another object of this invention is to provide a wall blaster which comprises a permanent magnet and wheels provided at the front surface of the housing thereof so as to movably arrange the housing thereof adjacent over the surface to be treated and to move the housing thereof while sandblasting.

DESCRIPTION OF THE PREFERRED EMBODIMENTS

Figure 3:
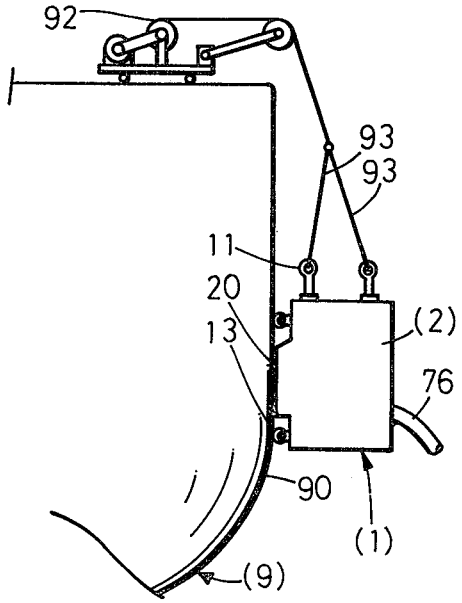
FIG. 3 is a front view of the wall blaster of this invention used for sandblasting the hull surface of a shipbuilding.

Referring now to FIG. 3, which shows one example of the wall blaster of this invention used in such a manner that an elevating or hoisting unit 92 is movably arranged on a shipbuilding 9 such as a tanker and the like and the wall blaster 1 of this invention is suspended by two suspension wires or ropes 93, 93 wound on a take-up drum in a manner that the blaster 1 is elevationally movably arranged adjacent to the hull surface 90 of a vessel over the surface 90.

Figure 1:
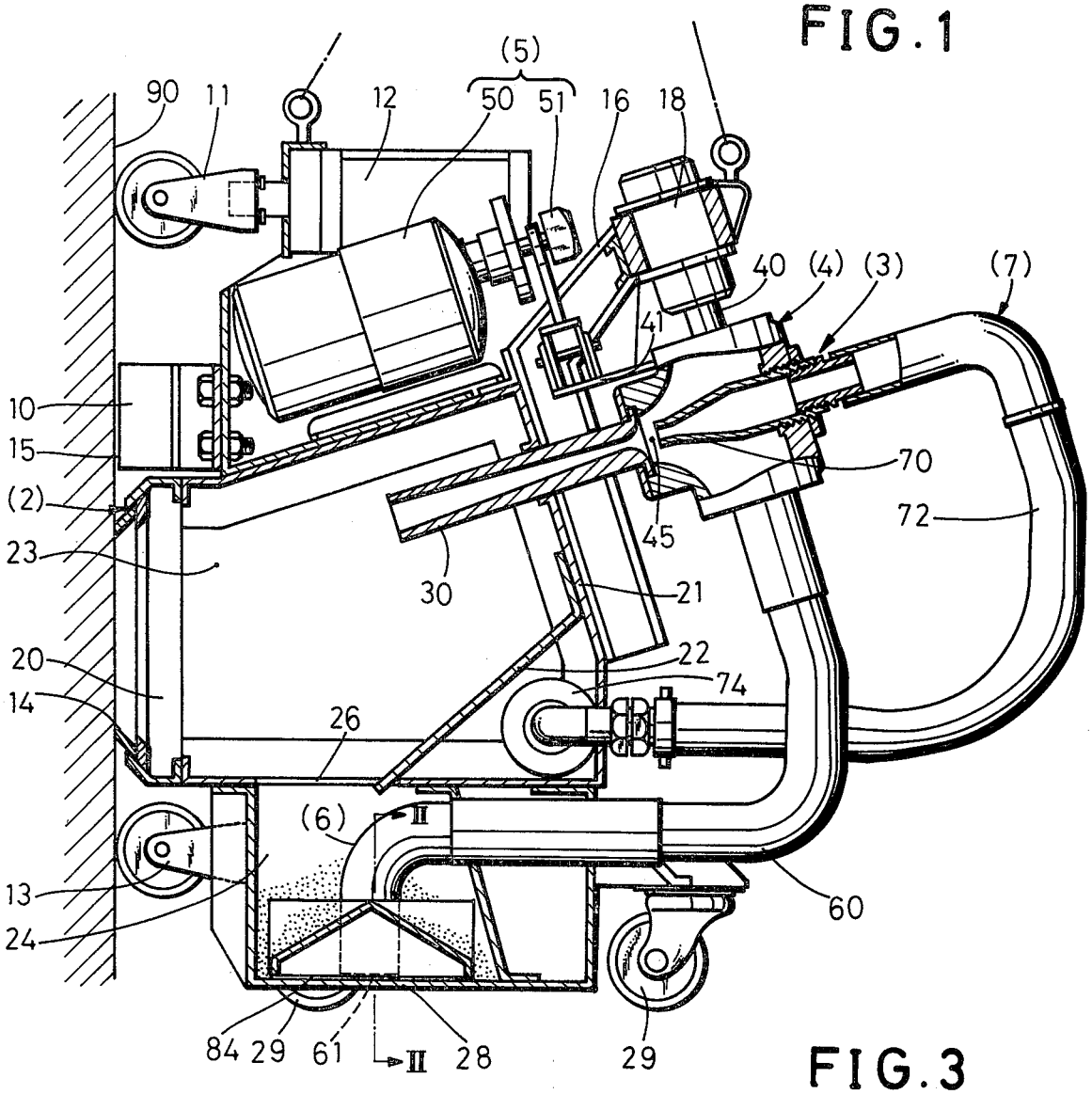
FIG. 1 is a partial fragmentary front view of the wall blaster according to this invention.

The wall blaster 1 comprises a body housing 2, drive wheels 11 and wheels 13, a magnetic attracter 10 (FIG. 1), a working sand injection unit 3 (FIG. 1), and a plurality of collecting nozzles 6 (FIG. 1). In FIG. 1, the housing 2 is so formed in opposite manner to the hull surface 90 as to have an opening 20 at the front surface thereof in a closed or sealed housing in such a manner that the interior thereof is divided into upper and lower chambers such as an injection chamber 23 and a working sand collecting chamber 24 by a partition wall 22 obliquely downwardly projected from the rear wall 21 so that a slot 26 is formed at the front edge of the partition wall 22 for communicating between the chambers 23 and 24 with each other. A dust protective member or frame 14 formed with a rubber membrane or the like is peripherally provided along the periphery of the front opening 20 of the housing 2 with the width reaching the hull surface 90 of the vessel so as to surround the opening 20 of the housing 2. Wheels 11, 11 and 13, 13 are projectingly provided on the upper and lower both sides of the front surface of the housing 2 of the blaster 1. These upper and lower wheels 11 and 13 are so projected forwardly toward the hull surface 90 of the vessel from the dust protective frame 14 as to roll on the hull surface 90 in such a manner that drive units 12 such as hydraulic cylinders and the like are engaged with the bases of the upper wheels 11 so that the upper wheels 11 may projectably be arranged toward the hull surface 90 from the front surface of the housing 2 of the blaster 1.

A magnetic attracter 10 having a permanent magnet is provided between the opening 20 and the upper wheels 11 in a manner that the hull surface attracting surface 15 thereof is attracted toward the front surface of the housing 2 so as to be attracted to the hull surface 90 with a slight interval or gap between the said attracting surface 15 and the hull surface 90.

A fitting frame 16 is projectingly provided in an obliquely upward direction at the fitting frame 16 of the rear wall 21 of the housing 2 of the blaster 1, and a plurality of working sand injection units 3 are rotatably supported in alignment with lateral direction of the housing 2 to the fitting frame 16.

The respective injection units 3 each has a shaft 40 projectingly provided therefrom toward the upper center of the ejector body 4 sealingly formed and rotatably mounted in support to bearings 18 arranged to the fitting frame 16 at the end thereof, and a manipulation lever 41 projectingly provided in the direction perpendicular to the shaft 40 and engaged with a reciprocating unit 5 provided with a speed reduction motor 50 and a crank mechanism 51 therewith, and each is so formed that the ejector bodies 4 are simultaneously rockably reciprocated in opposite directions of the housing 2 at the shaft 40 as an axis by means of the operation of the reciprocating unit 5.

The ejector body 4 is mounted with a sand injection nozzle 30 at the front side and with a compressed air injection tube 7 toward the same axis as that of the nozzle 30 at the rear side. The compressed air injection tube 7 is made of wear resisting metal material and is formed at the head in tapered convergent shape in a manner being extended immediately before the base of the sand injection nozzle 30 so as to form a space 45 for mixing the working sands with the air between the tube 7 and the injection nozzle 30.

There is provided a flexible blast tube 72 connected at one end to the base of the injection tube 7 and at the other to an accumulator 74 mounted in the housing 2. To the accumulator 74 is connected an air hose 76 (FIG. 3) communicating with a compressor (not shown) on the ground for injecting the compressed air from the head of the air injection tube 7 toward the sand injection nozzle 30 so as to produce a negative pressure or vacuum in the ejector body 4 by its ejector action. There is also provided a flexible sand hose 60 connected at one end to the bottom surface of the body 4 and at the other to the base of a sand collecting nozzle 6 provided in the sand collecting chamber 24.

Figure 2:
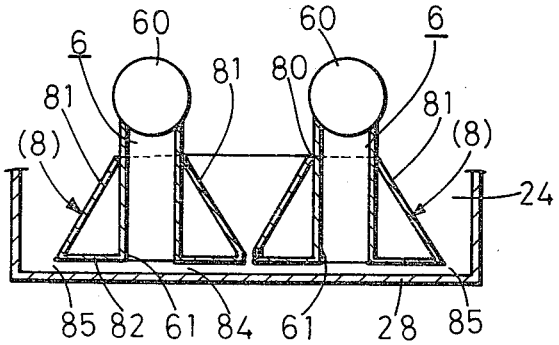
FIGS. 2 is a sectional view of a collecting nozzle taken along the line II—II in FIG. 1.

The sand collecting nozzle 6 is opened above the bottom wall 28 of the sand collecting chamber 24 at the head thereof, and a guide 8 is mounted to the opening 61 of the hose 60. As shown in FIG. 2, the guide 8 has a guide plate 81 mounted thereto and raised in projections at the center portions 80 of the respective sand collecting nozzles 6 inserted into the collecting chamber 24 in a manner that the guide plate 81 is expanded toward opposite downward sides with a lower plate 82 mounted in parallel with the bottom wall 28 of the sand collecting chamber 24 at the lowermost end thereof so as to form a narrow sucking gap 84 between the bottom wall 28 and the lower plate 82 with the collecting nozzle 6 opened at the gap 84 at the head thereof.

OPERATION

In order to sandblast the hull surface 90 of a vessel such as a tanker or the like, the wall blaster 1 is suspended by the suspension ropes 93 of the hoisting unit 92 after it is filled with a predetermined quantity of working sand in advance, and is arranged facing oppositely to the hull surface 90 of the vessel at the opening 20 thereof.

Since a magnetic force acts between the attracting surface 15 of the magnetic attracter 10 and the hull surface 90, the housing 2 of the blaster 1 receives a force approaching the hull surface 90 of the vessel while the distance between the opening 20 of the housing 2 and the hull surface 90 is maintained at a predetermined manner by means of the upper and lower wheels 11 and 13. Accordingly, the respective upper and lower wheels 11 and 13 are urged onto the hull surface 90 so as to move positively on the hull surface 90 even without using moving guide means therealong.

When compressed air is fed from the compressor (not shown) to the blast tube 72 after the wall blaster 1 is adjacently contacted on the hull surface 90, the compressed air from the compressed air injection tube 7 is injected toward the sand injection nozzles 30 in the ejector body 4, whereupon the interior of the body 4 is reduced in pressure by means of the ejector action so that a sucking force acts through the sand hose 60 to the collecting nozzle 6 with the result that high speed air flow is fed from the sucking opening 85 around the sucking gap 84 so as to suck the working sand on the bottom 28 of the collecting chamber 24 and the guide plate 81 into the nozzle 6 without any clogging occurring of the collecting nozzle 6. The working sand are fed from the opening of the sand hose 60 into the ejector body 4, are then mixed with the compressed air injected from the compressed air injection tube 7 in the space 45 of the body 4, are injected from the injection nozzle 30, and are blasted through the opening 20 of the housing 2 onto the hull surface corresponding to the opening 20 so as to blast rust, paint and dust adhered onto the hull surface 90 of the vessel.

Since the respective sand injection units 3 are rockably reciprocated by means of the reciprocating units 5 so as to rockably move the respective ejector bodies 4 and accordingly the injection nozzles 30 and to thus displace the injecting direction of the working sands, the entire hull surface 90 corresponding to the opening 20 of the housing 2 is uniformly blasted with working sand.

The hull surface 90 is sandblasted along the same width as that of the opening 20 of the housing 2 by operating the hoisting unit 92 to move the wall blaster 1 so as to displace the opening 20 of the housing 2 with respect to the hull surface 90 while sandblasting.

For the purpose of removing the wall blaster 1 from the hull surface 90 of the vessel, when the blaster 1 is moved downwardly by rolling the respective wheels 11 and 13 on the hull surface 90 by the operation of the hoisting unit 92 to the ground until movable wheels 29, 29 mounted onto the bottom surface of the housing 2 reach the ground and the drive unit 12 of the upper wheels 11 is then actuated to project the wheels 11 forwardly, the upper portion of the housing 2 is urged oppositely to the hull surface 90 and the magnetic attracter 15 is thus separated from the hull surface 90 so as to remove the blaster 1 simply from the hull surface 90.

It should be understood from the foregoing description that since the wall blaster of this invention comprises the wheels 11 and the magnetic attracter 10 arranged on the front surface of the housing 2, the opening 20 of the housing 2 can be positively moved along the hull surface 90 even having various uneven areas thereon and is particularly effective for sandblasting the bent hull surface of the vessel such as tanker and the like and also to accelerate working due to the absence of guide wires or ropes of the wall blaster 1.

It should also be understood that as the drive unit 12 is engaged with the wheels 11 for projecting the same forwardly, it can easily facilitate the simple installation and removal of the wall blaster 1 onto and from the hull surface.

I claim:

1. A wall blaster movable along a surface to be treated by suspending the blaster while injecting working sand toward an opening in the front surface of the housing with a plurality of sand injection nozzles provided in the housing comprising:

a sand collecting chamber arranged at the lower portion of the opening of the housing thereof and forming a gap between the bottom of the housing and the opening for accumulating the sand reflected from the surface to be treated, working said injection means having at least one air injection tube disposed in a hollow chamber and one sand injection nozzle aligned therewith in a manner that the head of the air injection tube is directed toward the base of the sand injection nozzle with a sand hose connected at one end to the hollow chamber at right angles to said air injection head; the head of the sand injection nozzle being directed toward the opening in the hollow chamber mounted to the housing, a sand collecting nozzle having a head thereof opened in said collecting chamber and a base communicated through a sand hose with the body, and a lower plate mounted in parallel with the bottom wall of said collecting chamber adjacent to the bottom wall thereof at the head of said sand collecting nozzle to form a narrow sucking gap between the bottom wall of said collecting chamber and the lower plate.

2. The wall blaster according to claim 1, wherein said chamber is laterally rockably secured to the side of the housing thereof and further comprising reciprocating means engaged with the body for rockably reciprocating the sand injection nozzle within the opening of the housing thereof.

3. A wall blaster movable along a surface to be treated by suspending the blaster housing while injecting working sand toward an opening in the front surface of the housing with a plurality of sand injection nozzles provided in the housing comprising:

a sand collecting chamber arranged at the lower portion of the opening of the housing thereof and forming a gap between the bottom and the opening for accumulating the sand reflected from the surface to be treated, a plurality of wheels projectingly arranged at the front surface of the housing and having a drive unit engaged therewith projectedly, magnetic attracter means having a permanent magnet and an attracting surface arranged toward the front surface of the housing, working sand injection means having at least one air injection tube disposed in a hollow chamber and one sand injection nozzle aligned therewith in a manner that the head of the air injection tube is directed toward the base of the sand injection nozzle with a sand hose connected at one end to the hollow chamber at right angles to said air injection tube; the head of the sand injection nozzle being directed toward the opening in the hollow chamber mounted to the housing, a sand collecting nozzle having a head thereof opened in said collecting chamber and a base communicated through a sand hose with the body, and a lower plate mounted in parallel with the bottom wall of said collecting chamber adjacent to the bottom wall thereof at the head of said sand collecting nozzle to form a narrow sucking gap between the bottom wall of said collecting chamber and the lower plate.

4. The wall blaster according to claim 3, wherein said body is laterally rockably secured to the side of the housing thereof and further comprising reciprocating means engaged with the body for rockably reciprocating the sand injection nozzle within the opening of the housing thereof.

* * * * *